US005113605A

United States Patent [19]

Kim

[11] Patent Number: 5,113,605

[45] Date of Patent: May 19, 1992

[54] LENGTH-VARIABLE MAGAZINE

[75] Inventor: Kwang M. Kim, Kyunggi-Do, Rep. of Korea

[73] Assignee: Dae Sam Co., Ltd., Seoul, Rep. of Korea

[21] Appl. No.: 552,123

[22] Filed: Jul. 13, 1990

[30] Foreign Application Priority Data

Feb. 6, 1990 [KR] Rep. of Korea ..... 90-1310[U]

[51] Int. Cl.[5] ..... F41A 9/71

[52] U.S. Cl. ..... 42/50

[58] Field of Search ..... 42/50

[56] References Cited

U.S. PATENT DOCUMENTS

| | | | |
|---|---|---|---|
| 1,044,983 | 11/1912 | Brown | 42/50 |
| 3,443,334 | 5/1969 | Ardolino | 42/50 |
| 4,472,900 | 9/1984 | Howard | 42/50 |
| 4,688,344 | 8/1987 | Kim | 42/50 |

*Primary Examiner*—Charles T. Jordan

*Attorney, Agent, or Firm*—Birch, Stewart, Kolasch & Birch

[57] ABSTRACT

A length-variable magazine which includes upper and lower magazine members having straight configuration for slidably coupling together with each other so as to be slidably extended or contracted, the upper magazine member being provided with a pair of flat springs having ball projections disposed thereon and a pair of projecting members on the opposite sides thereof, the lower magazine member being provided with through-holes and guide grooves disposed on the opposite sides thereof, a cartridge pad and an upper spring installed in the upper magazine member, an intermediate pad, a lower spring, and a lower pad installed in the lower magazine member in the cited order, whereby when the upper magazine member is inserted into the lower magazine member, the projecting members are coupled with the guide grooves so as to be extended or contracted relatively each other, and when the ball projections are coupled with the through-holes the length-variable magazine is slidably extended or contracted.

3 Claims, 5 Drawing Sheets

LENGTH-VARIABLE MAGAZINE

BACKGROUND OF THE INVENTION

1. Field of the Invention

The present invention relates to a length-variable magazine for small guns wherein the length of the magazine can be extended or contracted for loading a number of cartridges therein.

2. Description of the Prior Art

Various types of magazines are well known in the art. For example, conventional M16 rifles have a 20-cartridge loading type magazine and a 30-cartridge loading type magazine and these two types of magazines are separately produced.

In the case of such 30-cartridge loading type magazine, a cartridge is shaped such that a bullet is small in its diameter, and a shell having the detonating cap has a larger diameter compared with the bullet, while the lower portion of such magazine is gently curved in order to ease the actuation of a spring. Such magazine is not of a variable form but their outer structure is fixedly formed. Therefore, there is the disadvantage that such magazine has to be carried with its fixed structure regardless of the actual cartridge-loading capability.

In the case of the 30-cartridge loading magazine, even if a soldier wants that only 10 or 20 cartridges are loaded in the magazine, the soldier always has to use the 30-cartridge loading magazine which has a fixed bulk. Furthermore, in a battle field, a soldier has to carry 6 or 7 magazines. Therefore, the total volume of the magazines can give a severe impediment to the activities of the soldier with the ultimate result that an adverse effect is given to the combat ability of the soldier.

Also, in the case of the 30-cartridge loading magazine, it is difficult in manufacture because of the curved shape of the magazine as well as giving difficulties in carrying it. Due to the limitation of the restoring ability of the spring, the 20-cartridge loading magazine can actually accommodate only about 17 or 18 cartridges while the 30-cartridge loading magazine can actually accommodate only about 26 or 27 cartridges. Therefore, the remaining cartridges which are failed to be loaded have to be separately carried or discarded away, thereby aggravating the economic feature.

SUMMARY OF THE INVENTION

The present invention is intended to overcome the above described disadvantages of the conventional magazines.

Accordingly, it is an object of the present invention to provide a length-variable magazine wherein the length of the magazine can be extended or contracted and a large number of cartridges can be loaded even with its length contracted.

Another object of the present invention is to provide an improved length-variable magazine wherein the restoring ability of a spring of the magazine can be adjusted by adjusting the length of the magazine so that the maximum number of the cartridges can be loaded in an easy manner for preventing the loss of cartridges.

A further object of the present invention is to provide a length-variable magazine which can be carried in a contracted form for preventing cartridges from discarding, which can accommodate a larger number of cartridges compared with the conventional magazine of the same size, and which can be extended to increase the loading of cartridges during a combat for improving the combating ability of a soldier.

Still another object of the present invention is to provide a length-variable magazine including a spring which has sufficient restoring force due to the straight shape of the magazine so as to easily load more than 30 cartridges in the magazine, whereby the length-variable magazine is easy to manufacture because of the straight shape of the magazine as well as convenient to carry the magazine.

Yet another object of the present invention is to provide a magazine having the capacity of loading 20 or 30 cartridges but when the magazine is contracted, the contracted size of the magazine of the present invention is smaller than that of the conventional magazine of the same capacity so that the handling of the magazine becomes convenient especially during a combat, thereby improving the combat ability of a soldier.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a length-variable magazine which includes upper and lower magazine members having straight configuration for slidably coupling together with each other so as to be slidably extended or contracted, the upper magazine member being provided with a pair of flat springs having ball projections disposed thereon and a pair of projecting members on the opposite sides thereof, the lower magazine member being provided with through-holes and guide grooves disposed on the opposite sides thereof, a cartridge pad and an upper spring installed in the upper magazine member, an intermediate pad, a lower spring, and a lower pad installed in the lower magazine member in the cited order, whereby when the upper magazine member is inserted into the lower magazine member, the projecting members are coupled with the guide grooves so as to be extended or contracted relatively each other, and when the ball projections are coupled with the through-holes the length-variable magazine is slidably extended or contracted.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
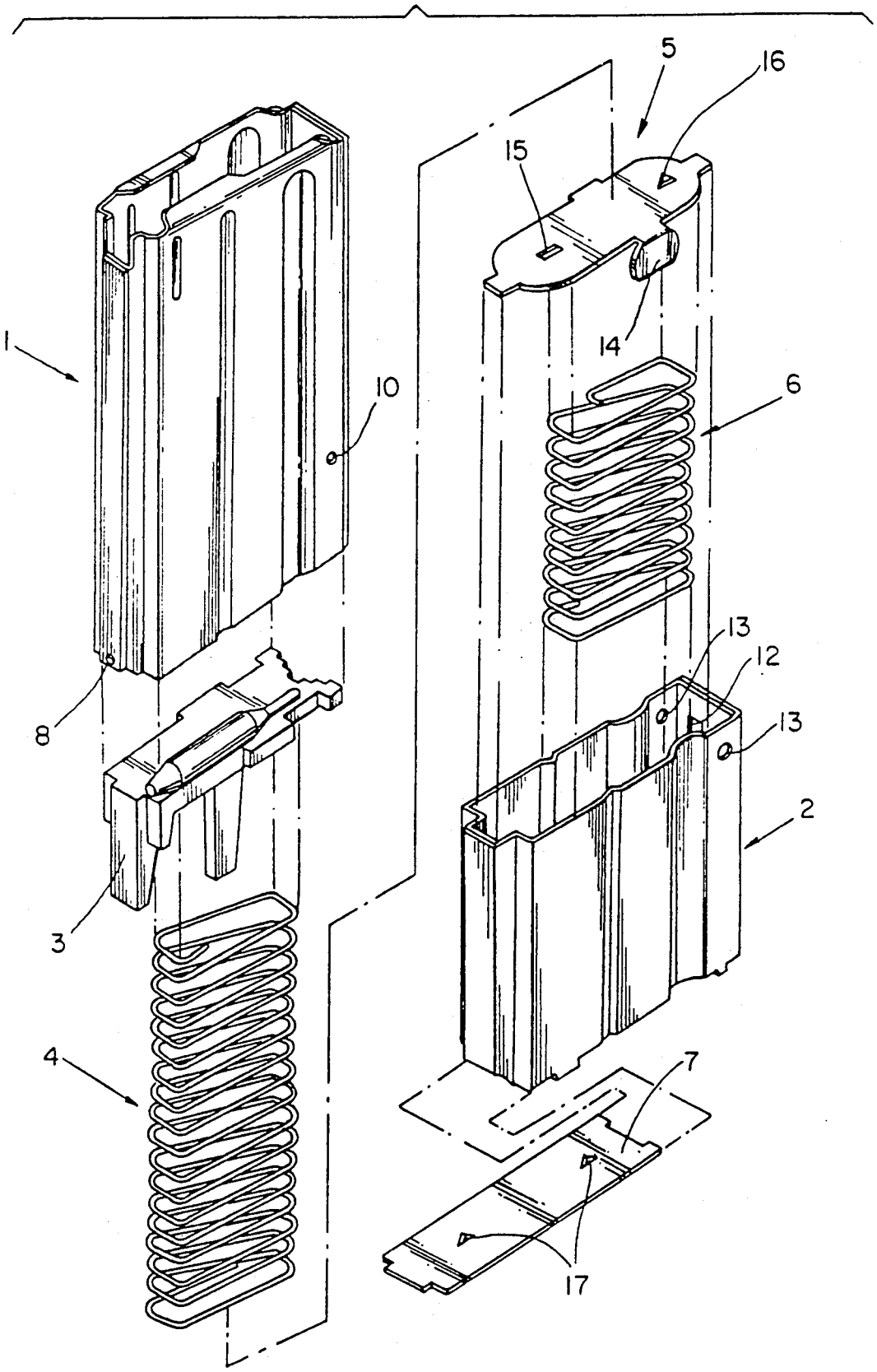
FIG. 1 is an exploded perspective view of the length-variable magazine according to the present invention.
Figure 2:
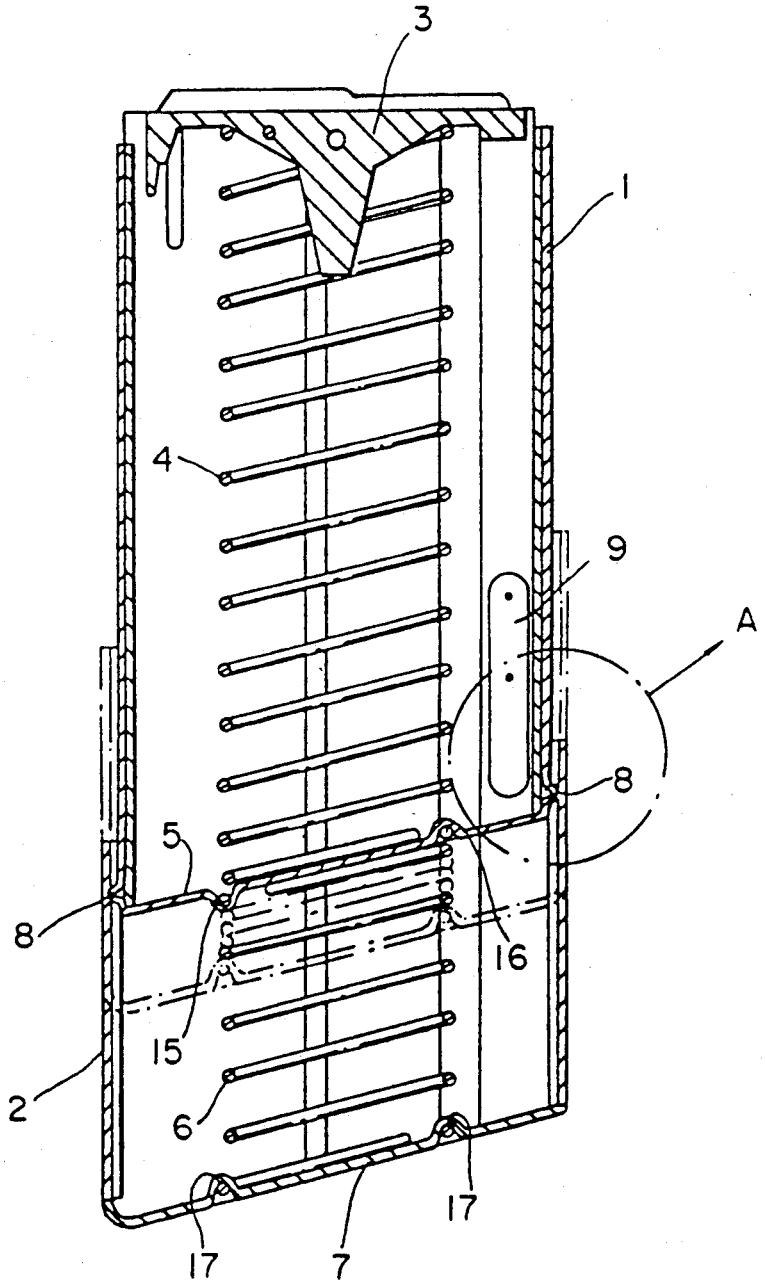
FIG. 2 is a longitudinal sectional view of the length-variable magazine of FIG. 1 illustrating the upper and lower magazine members coupled together.
Figure 3:
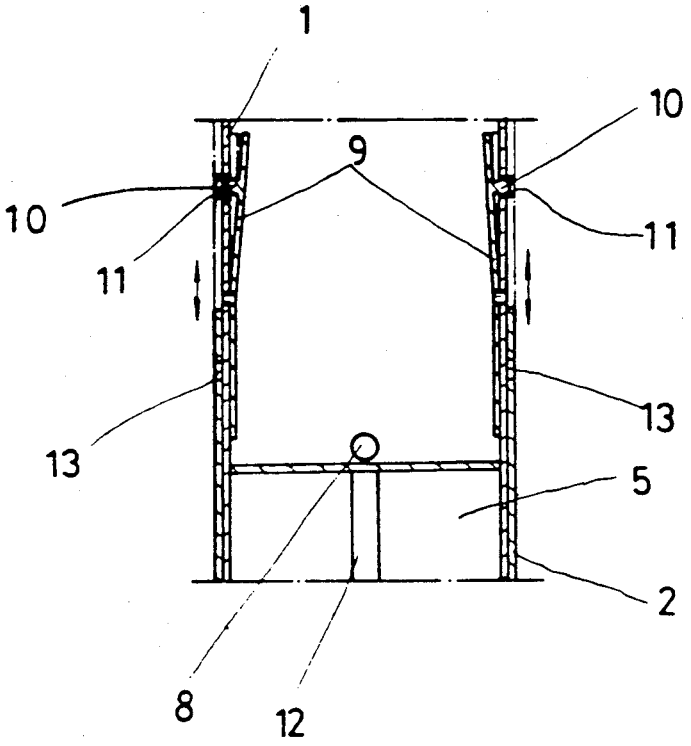
FIG. 3 is a sectional view of a locking member of the length-variable magazine according to the present invention.
Figure 4:
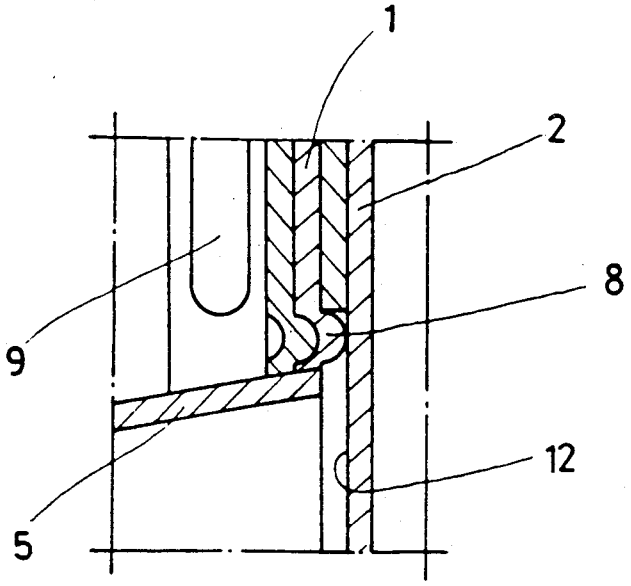
FIG. 4 is an enlarged sectional view of a portion A of FIG. 2.
Figure 5:
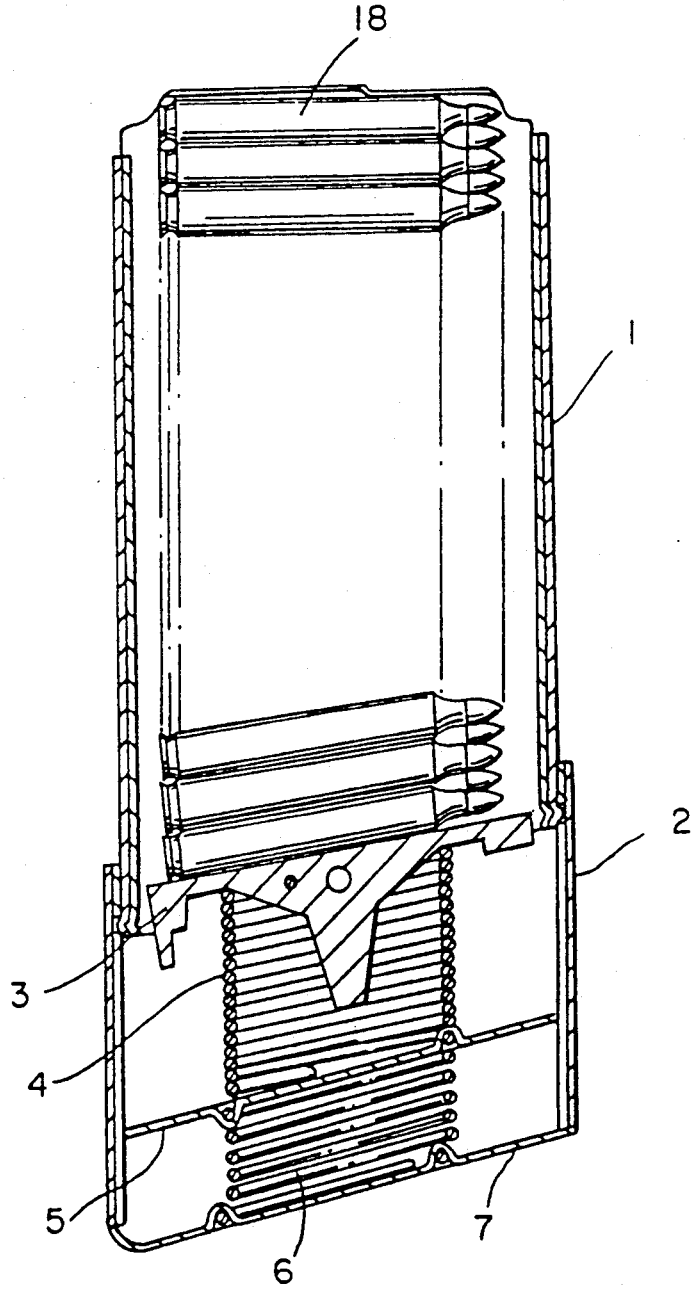
FIG. 5 is a sectional view showing the cartridges loaded into the magazine according to the present invention.
Figure 6:
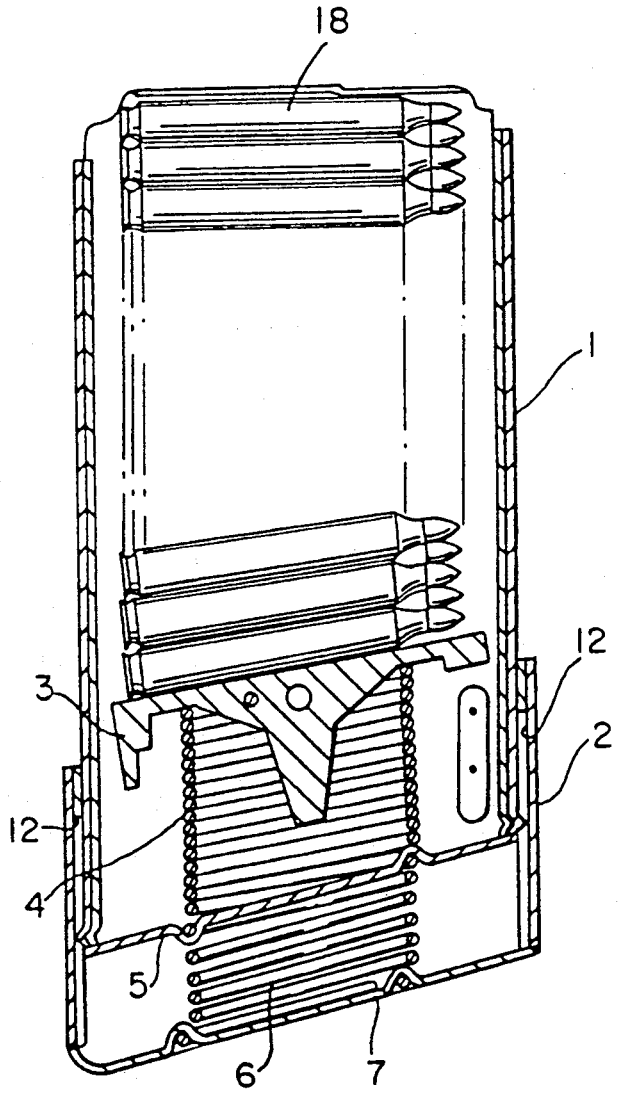
FIG. 6 is a sectional view showing the cartridges loaded into the magazine contracted to the minimum size.

Referring now in detail to the drawings for the purpose of illustrating preferred embodiments of the present invention, the length-variable magazine as shown in FIGS. 1 to 4 comprises an upper magazine member 1, a lower magazine member 2, a cartridge pad 3, an upper spring 4 connected to the cartridge pad 3 disposed within the upper magazine member 1, and an intermediate pad 5, a lower spring 6 and a lower pad 7 which are coupled together disposed within the lower magazine member 2.

The upper magazine member 1 is provided with a pair of projecting members 8 disposed at the bottom portions of both outer end walls thereof and a pair of flat spring 9 fixed to both inner side walls thereof wherein each of the flat springs 9 is provided with a ball projection 10 disposed at the upper portion thereof. The ball projections 10 of the flat springs 9 peep out through the through-holes 11, respectively and are fixed to the flat springs 9 by spot-welding and the like.

The lower magazine member 2 is provided with guide grooves 12 on the inner end-walls thereof and securing through-holes 13 on the side walls thereof. When the upper and lower magazine members 1 and 2 are coupled together, the projections 8 are engaged with the guide grooves 12. At this time, the upper and lower magazine members 1 and 2 are able to slide up and down each other. But the upper ends of the guide grooves 12 are closed so as to limit extension thereof, while upon the contraction of the magazine, the ball projections 10 are engaged with the through-holes 13 if necessary.

The intermediate pad 5 has a same configuration to be located in the lower magazine member 2 so that the intermediate pad 5 is able to slide up and down within the lower magazine member 2.

The intermediate pad 5 is provided with extending portions disposed at the left and right ends thereof and a rectangularly bent round portion 14. Furthermore, the intermediate pad 5 is provided with a shear-depressed portion 15 and a first shear-projected portion 16 so that the ends of springs 4 and 6 can be secured into the portions 15 and 16.

The lower pad 7 is provided with a pair of second shear-projected portions 17 and connected to the bottom of the lower magazine member 2.

The length-variable magazine according to when the length-variable magazine is not loaded with cartridges 18 in an empty state or loaded with a scanty number of cartridges 18, the length-variable magazine can be contracted to a shorter length by pushing either on of the upper and lower magazine members 1 and 2. At this time, the ball projections 10 of the upper magazine member 1 are engaged with the through-holes 13 of the lower magazine member 2.

On the other hand, when a number of cartridges 18 are to be loaded over the full load of the contracted state, the length-variable magazine is extended to a longer length by pulling out either one of the upper and lower magazine members 1 and 2 by making the projecting members 8 of the upper magazine member 1 halt at the ends of the guide grooves 12 of the lower magazine member 2. Thereafter, the cartridges 18 are loaded to be full.

When cartridges 18 are loaded into the length-variable magazine in a contracted or extended state, the elastic restoring forces of the upper and lower springs 4 and 6 are increased proportionately to the loaded cartridges 18. The intermediate pad 5 is gradually lowered toward the bottom of the lower magazine member 2.

On the other hand, when the cartridges 18 are consumed and the remaining cartridges 18 are gradually decreased, the intermediate pad 5 together with the upper and lower springs 4 and 6 rises upwardly. However, it is permitted only up to the bottom of the upper magazine member 1 owing to the fact that the size of the intermediate pad 5 is almost the same as the size of the bottom of the upper magazine member 1 so that the intermediate pad 5 cannot enter into the upper magazine member 1.

Thus, when the length-variable magazine is coupled with a rifle and shootings are made to consume the cartridges 18 and to make the cartridge pad 3 rise, the intermediate pad 5 occurs by itself and the upper and lower springs 4 and 6 independently perform rising or falling movements.

Therefore, the length-variable magazine according to the present invention has advantages such that (1) the length of the magazine can be properly contracted so as to make it possible to carry a large number of cartridges 18 with the reduced volume, (2) the elastic restoring forces of the springs 4 and 6 can be adjusted by varying the length of the magazine of the straight shape so as to make it possible to load cartridges 18 to the maximum capacity of the magazine and prevent the cartridge-discarding trend, (3) when the combat need is encountered after carrying the magazine in a contracted short state, the magazine can be extended to the longer length to load a larger number of cartridges 18 compared with the conventional magazine of the same capacity and consequently to improve the combat ability of a soldier, and (4) the magazine is easy to manufacture and convenient in use since the shape of the magazine is straight.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A length-variable magazine comprising:

an upper magazine member provided with a pair of projecting members disposed at the bottom portions of both outer end walls thereof and a pair of flat springs disposed at the lower portions of both inner walls, each of said flat springs being provided with a ball projection, a lower magazine member provided with guide grooves vertically disposed at inner end walls thereof for slidably receiving said projecting members and a pair of securing through-holes disposed at the upper portions of side walls thereof for slidably receiving said ball projections, a cartridge pad and an upper spring disposed within said upper magazine member for loading cartridges thereon, and an intermediate pad, a lower spring, and a lower pad disposed within said lower magazine member for supporting the upper spring, whereby upon coupling the upper and lower magazine members, the length-variable magazine can be variably extended or contracted accordingly such that the projecting members are engaged with the guide grooves and the ball projections are engaged with the securing through-holes.

2. The length-variable magazine of claim 1, wherein the intermediate pad has a same configuration as said lower magazine member, a rectangularly bent round portion, and a shear-depressed portion and a shear-projected portion for fixing the upper and lower springs.

3. The length-variable magazine of claim 1, wherein the lower pad fixes the lower spring.

* * * * *